United States Patent [19]

Tucker et al.

[11] Patent Number: 4,846,146

[45] Date of Patent: Jul. 11, 1989

[54] COOKING APPARATUS VENTILATION SYSTEM WITH RECYCLING AIR FLOW

[76] Inventors: James L. Tucker, 5363 110th St., Jacksonville, Fla. 32244; Takatoshi Yano, 2040 Deer Run Trail, Jacksonville, Fla. 32216; Roy L. Turknett, Rte. 1, Keystone Heights, Fla. 32656

[21] Appl. No.: 144,054

[22] Filed: Jan. 15, 1988

[51] Int. Cl.[4] ..... F24C 15/20

[52] U.S. Cl. ..... 126/299 D; 126/41 R; 126/300; 98/115.1

[58] Field of Search ..... 126/21 R, 21 A, 41 R, 126/299 R, 299 D, 300–303, 215, 299 C; 98/36, 115.1, 115.3; 55/DIG. 36

[56] References Cited

U.S. PATENT DOCUMENTS

| | | | |
|---|---|---|---|
| 3,292,525 | 12/1966 | Jensen | 126/299 R |
| 3,800,689 | 4/1974 | Brown | 126/299 D |
| 3,994,210 | 11/1976 | Davis | 98/36 |
| 4,063,495 | 12/1977 | Duvlis | 98/36 |
| 4,160,407 | 7/1979 | Duym | 98/115 R |
| 4,291,668 | 9/1981 | Moeller | 129/41 R |
| 4,603,684 | 8/1986 | Kazuo et al. | 126/299 D |

FOREIGN PATENT DOCUMENTS

| | | | |
|---|---|---|---|
| 473883 | 3/1929 | Fed. Rep. of Germany | 98/115.1 |

*Primary Examiner*—James C. Yeung

*Attorney, Agent, or Firm*—Thomas C. Saitta

[57] ABSTRACT

A cooking apparatus ventilation system which evacuates smoke and vapors to allow indoor cooking. Air is evacuated through ventilation channels which surround all but one side of the cooking surface. A layer of air is directed from the fourth side across the cooking surface to push the smoke and vapor into the ventilation channels. A portion of the evacuated air is recycled back across the cooking surface to enhance the flavor of the food being cooked.

11 Claims, 2 Drawing Sheets

COOKING APPARATUS VENTILATION SYSTEM WITH RECYCLING AIR FLOW

BACKGROUND OF THE INVENTION

This application is related to co-pending application. Ser. No. 143,667, entitled Cooking Apparatus Ventilation System, filed by the same inventors on Jan.14, 1988.

Almost every cooking method, such as grilling, frying, boiling, etc., results in the production of smoke, vapors, steam or other by-products which must be removed when the cooking is done indoors. The common arrangement is to locate a hood above the cooking area which confines the smoke or vapors after they have risen. The hood is evacuated through some sort of venting system.

It is the popular style in many restaurants to prepare certain foods at the customer's table rather than in a separate kitchen. The usual arrangement has the customers sitting around three sides of a table, the other side of which contains a cooking surface, usually a griddle. A hood is situated well above the cooking surface to confine the smoke and vapors after they have risen. Because the hood must be placed high enough to be out of the line-of sight of the customers, drafts in the restaurant can drive the smoke and vapors laterally before they reach the confines of the hood, often annoying the customers seated at the table. Also, the presence of a number of hoods throughout the restaurant is not aesthetically pleasing.

One solution to this problem is to provide a suction venting system at or near the cooking surface. A fan or similar means is used to withdraw air through openings at the rear or around the sides of the cooking surface. The smoke and vapors are drawn into the venting system and evacuated outside the room. Examples of these systems are taught in Moeller U.S. Pat. No. 4,291,668 ,Cerola U.S. Pat. No. 4,562,827 , Jenn U.S. Pat. Nos. 3,853,115 and 3,474,724 , and Field U.S. Pat. No.3,712,819.

The major problem with these systems is that the area of the cooking surface must be kept small enough so that smoke and vapors created in the center of the surface will still be entrapped by the suction of the venting system. It is impractical if not impossible to create venting systems with enough suction to draw in all the smoke and vapors created on a large cooking surface. For example, it is common to have restaurant grills as large as five feet by three feet, or even larger. With such a grill, smoke and vapors can be several feet from the nearest vent opening. This inventions solves this problem by directing a horizontal flow of forced air above and across the cooking surface, thereby preventing the smoke and vapors from rising, as well as forcing them into the vent openings. In addition to solving this problem, the invention improves upon the process by recycling a portion of the air, now containing some smoke from the cooking process, back across the food, thereby enhancing the flavor. This is especially true when grilling is being done. None of the prior art cited incorporates this recycling feature.

BRIEF SUMMARY OF THE INVENTION

The invention is a ventilation system incorporated in a cooking apparatus to be used in indoor cooking. The cooking apparatus may be of any type which produces smoke or vapors during the cooking process, including grills, griddles, fryers or individual heating elements.

Forced air, as produced by a fan of a compressor, is directed in a full horizontal, planar pattern slightly above the cooking surface, creating a blanket of air which prevents any smoke or vapor from rising vertically. At the same time, this blanket of air directs the smoke and vapors toward the venting channels. A fan or other means is used to created negative pressure in the channels such that the entire quantity of forced air, as well as some room air, is drawn into the venting channels. The majority of this evacuated air is exhausted out of the room, but a small portion of this air is recycled by a fan and duct arrangement back across the cooking surface.

DETAILED DESCRIPTION OF THE INVENTION

The particular cooking surface incorporated or used with the invention is not of importance. The term grill will be used throughout this specification to represent any cooking surface or device which produces smoke or vapors, including but not limited to grills, griddles, heating element or frying systems.

Figure 1:
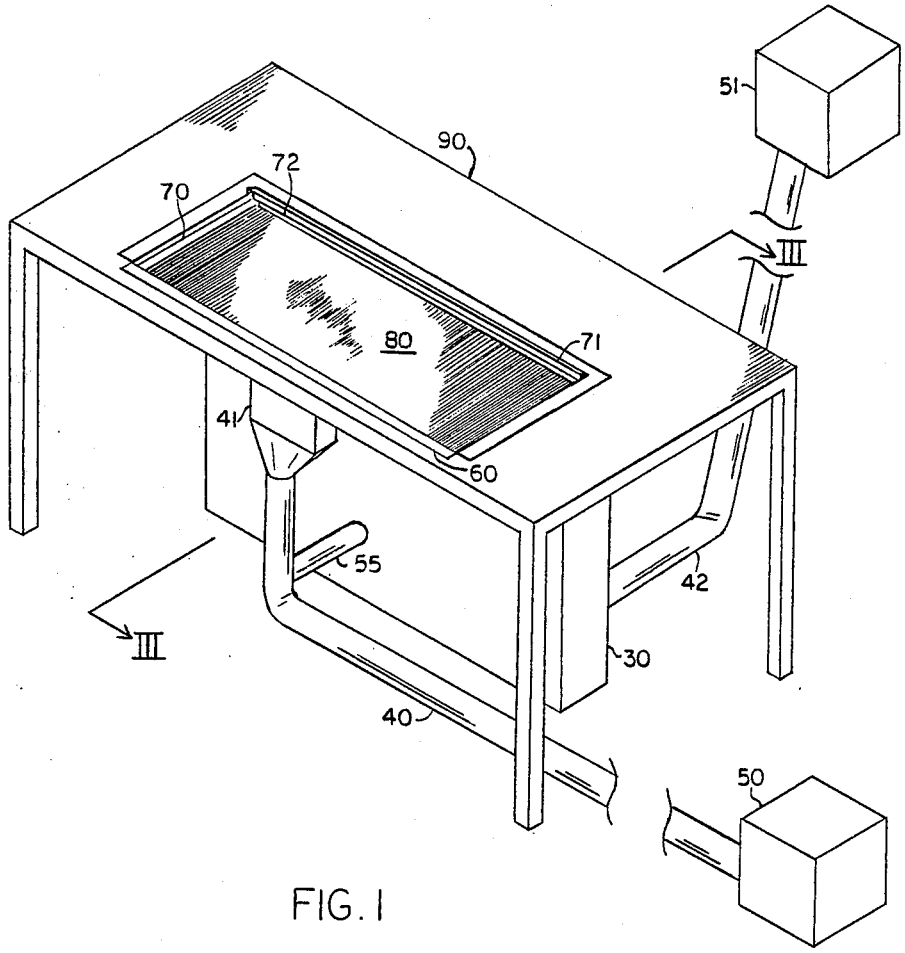
FIG. 1 is an isometric view of the invention as contained in a table, with the forced air means and evacuation means represented by boxes.

As shown in FIG. 1, the invention is typically housed in a large table 90 such that three sides of the table can be used for individual dining. The invention may be placed within any horizontal surface, or may be utilized independently of a table. The invention comprises a grill cooking surface 80 bounded on three sides by two venting channels 70 and a receiving venting channel 72. The remaining side (a long side if the grill is not square) is bounded by the air ingress housing 60. Opposite of the air ingress housing 60, a deflector 71 is situated adjacent to the upper lip of the receiving venting channel 72. Preferably, the upper surface of the venting channels 70 and 72, and the air ingress housing 60 are level with the upper surface of table 90.

Forced air is supplied by a forced air means 50, which can be a fan, blower or compressor, represented by a box in FIG. 1. Air is forced through inlet conduit 40 into the air chamber 41. Air chamber 41 is connected to the bottom of air ingress housing 60. Smoke and vapors are removed by an evacuation fan 51 or similar means, represented by another box in FIG. 1. The evacuation fan 51 draws air through outlet conduit 42 from evacuation chamber 30. Evacuation chamber 30 runs substantially the length of the receiving venting channel 72. In alternate design, the evacuation chamber 30 may be substantially shorter than the length of the receiving venting channel 72. Recycling duct 55 allows a portion of the air in evacuation chamber 30 to be redirected through air chamber 41, into air ingress housing 60, and across grill 80.

Figure 2:
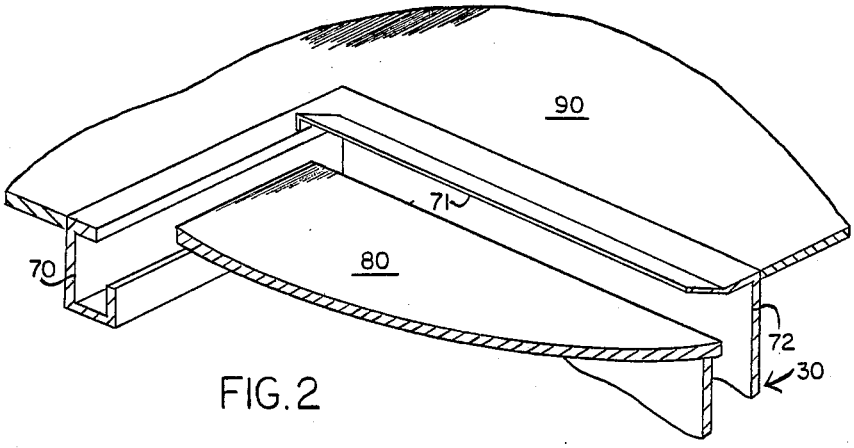
FIG. 2 is a cut-away view of a portion of the invention showing the relationship of the grill to the venting channels.

The relationship of the venting channels 70 and 72 to the grill 80 is better seen in FIG. 2. The venting channels 70 perpendicular to the air ingress housing 60 are of a general "C" shape such that the short vertical leg becomes a support for the underside of grill 80. The upper horizontal leg forms a lip which creates an ingress channel along the entire edge of the grill 80 and the shape of the venting channel 70 is such that a hollow, extended chamber is formed. This chamber is connected to the evacuation chamber 30 by the receiving venting channel 72 opposite the air ingress housing 60. This receiving venting channel 72 forms the upper portion of evacuation chamber 30. The deflector 71 runs the length of receiving venting channel 72.

Figure 3:
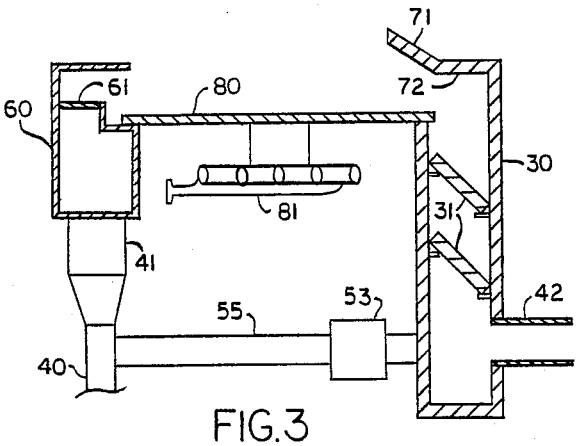
FIG. 3 is a sectional view along line III—III of FIG. 1, showing the forced air ingress means, the grill, the evacuation chamber and the recycling duct.

Referring now to FIG. 3, grill 80 (shown with burner components 81) spans the distance between evacuation chamber 30 and air ingress housing 60. Air ingress housing 60 is an elongated chamber, closed on each end. Forced air is supplied through inlet conduit 40 and air chamber 41 into the central portion of air ingress housing 60. The only outlet for this forced air is through perforated plate 61, which runs the length of the air ingress housing 60. The perforations insure that the flow of forced air through plate 61 is equal over its entire length. The upper lip of air ingress housing 60 directs the air horizontally across the surface of grill 80, entrapping any smoke or vapor created during cooking. This air is then drawn into venting channels 72 and 70. Deflector 71 creates a larger receiving channel in the direction of the air flow. The smoke and vapors are drawn into evacuation chamber 30, through filters 31 and then through outlet conduit 42, where they are exhausted outside the room. The force, height and direction of the blanket of forced air is such that all of this air is directed at and into the suction region of the venting channels 70 and 72.

The entire quantity of air drawn into evacuation chamber 30 is not exhausted through outlet conduit 42. Recycling duct 55 connects evacuation chamber 30 directly to inlet conduit 40 and air chamber 41. A small recycling fan 53, represented by the box in FIG. 3, which is approximately one-fifth the capacity of evacuation fan 51, draws roughly 20 percent of the air from evacuation chamber 30 and recycles it back through recycling duct 55. This recycled air is then blown back across grill 80 in the normal forced air path.

Figure 4:
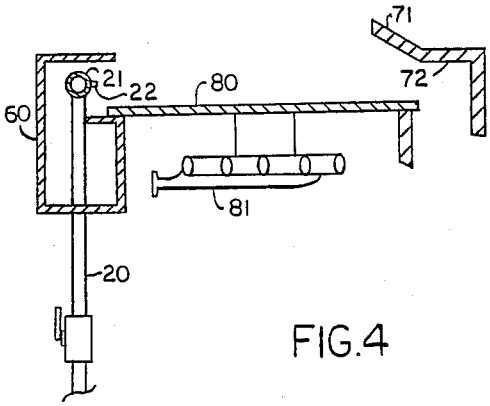
FIG. 4 is a sectional view similar to FIG. 3, where a compressed air ingress means has been substituted for the forced air ingress means.

An alternate embodiment is illustrated in FIG. 4. Instead of a forced air system created by a fan or blower, the blanket of air is created with compressed air. Inlet conduit 40 is replaced by inlet pipe 20 and the air supply means is a compressor. Inlet pipe 20 passes through the air ingress housing 60 and is joined to horizontal air pipe 21 to create a T-shape. Air pipe 21 runs the length of air ingress housing 60, parallel to and a slight distance above the surface of grill 80. Apertures or nozzles 22 are positioned at spaced intervals along air pipe 21. The compressed air is thus directed over the surface of the grill 80, entrapping any smoke or vapors and forcing them into the venting channels 72 and 70. In this embodiment, recycling duct 55 is connected to air ingress housing 60 such that the smoke is admitted below the compressed blanket of air. In this way the smoke is recycled across grill 80, yet remains trapped in the ventilation system.

The efficiency of the device is determined by the relationship between the evacuation fan 51 and the forced air means 50. Both are designed to be adjustable so that each can be independently increased or decreased in response to the situation. In order to insure that all smoke and vapors are removed, the amount of air evacuated through the device is set to be greater than the amount of air forced across the grill 80. Thus all of the forced air will be drawn into the venting channels 70 and 72, as well as some of the ambient room air. The larger the grill 80, the greater is the evacuation required. For a grill size of two feet by three feet, the evacuation fan 51 should be capable of evacuating 1400 cubic feet of air per minute. For a grill of two feet by five feet, the evacuation required is 2100 cubic feet per minute.

Since the invention is designed for indoor use, environmental and energy considerations are important. The source of forced air should be external to the room, since the forced air will be exhausted after passing over the cooking surface. Likewise, the evacuated air should be exhausted externally. It is also beneficial to maintain the settings for the amount of air evacuated to be near the amount of air forced in, so that only so much of the air-conditioned internal air is evacuated as is necessary to maintain the efficacy of the system.

The design of the invention is such that a number of units may be connected to a single forced air means 50 and a single evacuation fan 51. Of course, the capacity of these must necessarily be increased to accommodate the multiple units.

It is also a matter of choice in which direction the air is forced across the grill 80 in relation to table 90. As illustrated, the air is forced away from the person cooking. It is also envisioned that the air can be forced toward the cook.

Another embodiment of the invention allows for vertical adjustment of air ingress housing 60 relative to the surface of grill 80 . In circumstances where the smoke and vapors are produced a distance from the grill surface, for instance if pans or pots are utilized, the air ingress housing 60 can be raised and angled downward. In this way the smoke and vapors are still directed into venting channels 70 and 72 by the blanket of air.

The invention has been described as an integral cooking unit comprising both the cooking apparatus and the ventilation system. Another embodiment of the invention has the cooking apparatus removable from the ventilation system. In this embodiment, various types of cooking surfaces can be interchanged by removing one cooking surface and replacing it with another cooking surface, such that the position of the second surface is properly situated with respect to the ventilation system.

The embodiments set forth above are not exhaustive as to the nature of the invention. One skilled in the art should realize that variations and substitutions of elements are suggested by the disclosure. The full scope of the invention is therefore to be as set forth in the following claims.

We claim:

1. A cooking apparatus ventilation system, mounted in a table or other horizontal surface, comprising:

(A) a cooking surface situated below the surface of the table or other horizontal surface;

(B) evacuation means comprising one or more venting channels adjacent to one or more side of the cooking surface, said venting channels situate below or even with the surface of the table or other horizontal surface, to downwardly remove a quantity of air from the region directly above the cooking surface and exhaust this air away from the device, where the evacuation means further comprises an evacuation chamber and outlet conduit, where such chamber and conduit are situated below the surface of the table or other horizontal surface and where said venting channels are situated to support the cooking surface around its perimeter;

(C) forced air means directing a quantity of air horizontally or downwardly across the cooking surface in the direction of the evacuation means, such that all of the air from the forced air means is removed by the evacuation means; and (D) recycling means whereby a portion of the air removed by the evacuation means from the region directly above the cooking surface is directed horizontally or downwardly across the cooking surface within or below the quantity of air directed by the forced air means.

2. The device of claim 1, where said venting channels surround three sides of the cooking surface, the venting channels facing each other being of a general "C" shape such that air is channeled into the venting channel opposite the forced air means which channel forms the upper portion of said evacuation chamber.

3. The device of claim 2, further comprising a deflector above the venting channel opposite the forced air means.

4. The device of claim 2, where the forced air means comprises a fan.

5. The device of claim 2, where the forced air means comprises a compressor.

6. The device of claim 2, where the evacuation means further comprises an adjustable fan.

7. The device of claim 2, where the forced air means is vertically adjustable relative to the cooking surface.

8. The device of claim 2, where the cooking surface is interchangeable.

9. The device of claim 2, where the recycling means comprises a duct connecting the evacuation means to the forced air means.

10. The device of claim 9, where the recycling means further comprises a fan.

11. The device of claim 10, where the recycling means directs approximately twenty percent of the removed air back into the forced air means.

* * * * *